US006915817B2

(12) United States Patent
Benstead et al.

(10) Patent No.: US 6,915,817 B2
(45) Date of Patent: Jul. 12, 2005

(54) MOVEABLE HOSE RETRACTOR FOR A PULL-OUT FAUCET

(75) Inventors: Evan Alan Benstead, Los Angeles, CA (US); Steven Nadler, Trabuco Canyon, CA (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 10/428,203

(22) Filed: May 1, 2003

(65) Prior Publication Data

US 2004/0216789 A1 Nov. 4, 2004

(51) Int. Cl.[7] ..... E03C 1/04
(52) U.S. Cl. ..... 137/355.25; 137/801
(58) Field of Search ..... 137/355.25, 801

(56) References Cited

U.S. PATENT DOCUMENTS

| | | | | |
|---|---|---|---|---|
| 2,608,409 | A | 8/1952 | Pinkerton | |
| 3,716,239 | A | 2/1973 | Goudreau | |
| 3,971,559 | A | 7/1976 | Diforte, Jr. | |
| 4,260,150 | A | 4/1981 | Tabet | |
| 4,827,538 | A | 5/1989 | Heimann | |
| 5,090,062 | A | 2/1992 | Hochstrasser | |
| 5,095,554 | A | 3/1992 | Gloor | |
| 5,361,431 | A | 11/1994 | Freier | |
| 5,575,424 | A | 11/1996 | Fleischmann | |
| 5,771,934 | A | 6/1998 | Warshawsky | |
| 5,960,832 | A | 10/1999 | Warshawsky | |
| 6,250,338 | B1 | 6/2001 | Dempsey | |
| 2004/0010848 | A1 * | 1/2004 | Esche | 4/675 |

* cited by examiner

*Primary Examiner*—Gerald A. Michalsky
(74) *Attorney, Agent, or Firm*—Richard J. Veltman; John D. DelPonti

(57) ABSTRACT

Certain exemplary embodiments provide a device comprising a unitary toroidal hose retractor for use with a pull-out hose, said hose retractor defining a passage there-through having a passage width greater than an outer width of the pull-out hose, an inner portion of a radial cross-section of said hose retractor defining a conic segment having a focal point and a conic segment radius measured from said focal point.

39 Claims, 6 Drawing Sheets

MOVEABLE HOSE RETRACTOR FOR A PULL-OUT FAUCET

BRIEF DESCRIPTION OF THE DRAWINGS

The invention and its wide variety of potential embodiments will be readily understood via the following detailed description of certain exemplary embodiments, with reference to the accompanying drawings in which.

DETAILED DESCRIPTION OF THE DRAWINGS

According to an exemplary embodiment of a method of the present invention, a hose retractor can be slid onto a hose that will connect a pull-out faucet to a pipe. The hose retractor can be freely slideable on the hose such that it assists in retracting the pull-out faucet to a "home" position after the faucet has been pulled out for use.

Figure 1:
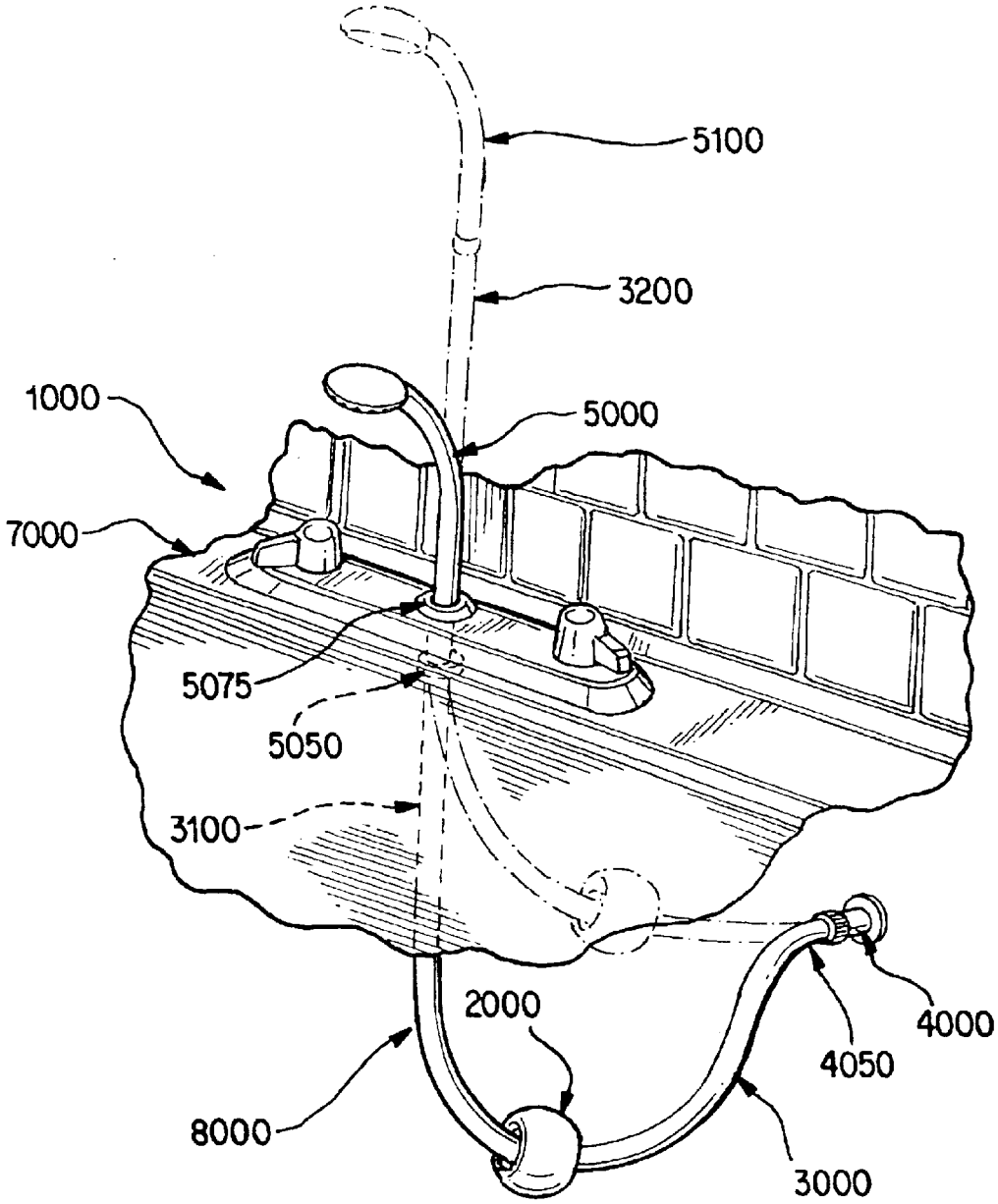
FIG. 1 is a perspective view of an exemplary embodiment of a system 1000 of the present invention showing an exemplary hose retractor slideably mounted on a hose for a pull-out hand held spray faucet.

FIG. 1 is a perspective view of an exemplary embodiment of a system 1000 of the present invention showing an exemplary hose retractor 2000 slideably mounted on a flexible hose 3000 for a pull-out hand held spray faucet 5000. Hose retractor 2000 can be a unitary device comprising a polymer-enclosed core, which may be made from lead. Hose retractor 2000 can be supported upon hose 3000. Water can flow through hose 3000 from a water source 4000 to hand-held spray nozzle or faucet 5000, particularly when faucet 5000 is activated.

Hose 3000 can be constructed in any known manner, including of a polymer (which can include natural and/or synthetic rubber), of a composite that includes a polymer, metal, fiber, and/or fiberglass, and/or of a polymer and/or composite liner surrounded by a covering, such as a helically-wound, braided, or mesh polymeric, fiber, fiberglass, and/or metallic (e.g., stainless steel, brass, etc.) covering, etc. Hose 3000 can have any inner diameter, outer diameter, length, or wall thickness. For example, for certain faucets and/or embodiments, hose 3000 might have an outer diameter selected from a range of about 0.20 to about 1 inch, including all value therebetween, such as about 0.375, 0.440, 0.50, 0.625, 0.640, 0.75 inches, etc, and/or every range therebetween. Hose 3000 can be inserted through a passage in hose retractor 2000 so that hose retractor 2000 can slide along hose 3000. For example, hose retractor 2000 can freely slide along hose 3000 when hand-held spray faucet 5000 is repositioned to a desired position of use 5100 away from its home position 5075.

Thus, hose retractor 2000 can be positioned upon hose 3000 so that it slideably surrounds hose 3000, and the first terminal end 4050 of hose 3000 can be attached to a fixed fluid dispensing device, such as a water source 4000 (e.g., a pipe, tube, hose, fitting, valve, etc.), and the second terminal end 5050 of hose 3000 can be attached to a fluid flow regulation device, such as hand-held spray nozzle, sprayer, and/or faucet 5000. When hand-held spray faucet 5000 is repositioned to a desired position of use 5100 away from home position 5075, hose 3000 can extend from a storage area 8000 under a sink 7000 and hose retractor 2000 can slide freely along that portion 3100 (i.e., (the hidden portion) of hose 3000 that remains under the sink 7000. When hand-held spray faucet 5000 is returned to home position 5075, hose retractor 2000 can also slide freely along hose 3000, assisting in retracting at least a portion of the extended, unhidden, and/or visible portion 3200 of hose 3000.

Since hand-held spray faucet 5000 is often repositioned to a position different from its home position 5075 when it is in use, hose 3000 may be movable in conjunction with hand held spray faucet 5000. Thus, hose 3000 can be made of a flexible, lightweight material. Because hose 3000 is typically lightweight, however, it can lack sufficient mass to return hand-held spray faucet 5000 to its home position 5075 after hand-held spray faucet 5000 is repositioned to a desired position of use 5100.

In this manner, hose retractor 2000 can freely slide along hose 3000 when hand-held spray faucet 5000 is moved and/or repositioned to a desired position of use 5100. Retractor 2000 can have a mass sufficient to return and/or assisting in returning hand-held spray faucet 5000 back to its home position 5075. In certain embodiments, hose retractor 2000 can have a mass that is greater than a combined mass of hand-held spray faucet 5000, a visible or above-sink portion 3200 of the hose 3000 located between hose retractor 2000 and hand-held spray faucet 5000, and/or the fluid contained within the visible portion 3200 of hose 3000. Retractor 2000 can have a mass less than a mass required to dysfunctionally deform hose 3000 when the mass of hose retractor 2000 is applied over an area defined by contact of hose retractor 2000 with hose 3000. As used herein, the phrase "dysfunctionally deform" means a deformation of hose 3000 that reduces the flow rate through hose 3000 by at least 10, 20, and/or 30 percent (including every value therebetween and/or every range therebetween) and/or causes a permanent deformation of the outer surface of hose 3000 sufficient to prevent hose retractor 2000 from freely sliding along hose 3000.

Figure 2:
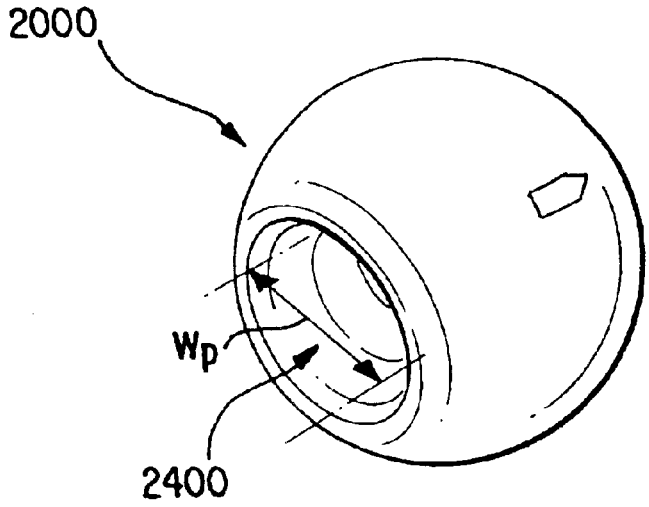
FIG. 2 is a perspective view of an exemplary embodiment of a hose retractor 2000 of the present invention.

FIG. 2 is a perspective view of an exemplary embodiment of a hose retractor 2000 of the present invention. Hose retractor 2000 can be a unitary toroidal shape, which can define a passage 2040 there-through. That is, hose retractor 2000 can be an uninterrupted, continuous, and/or one-piece toroid.

Figure 3:
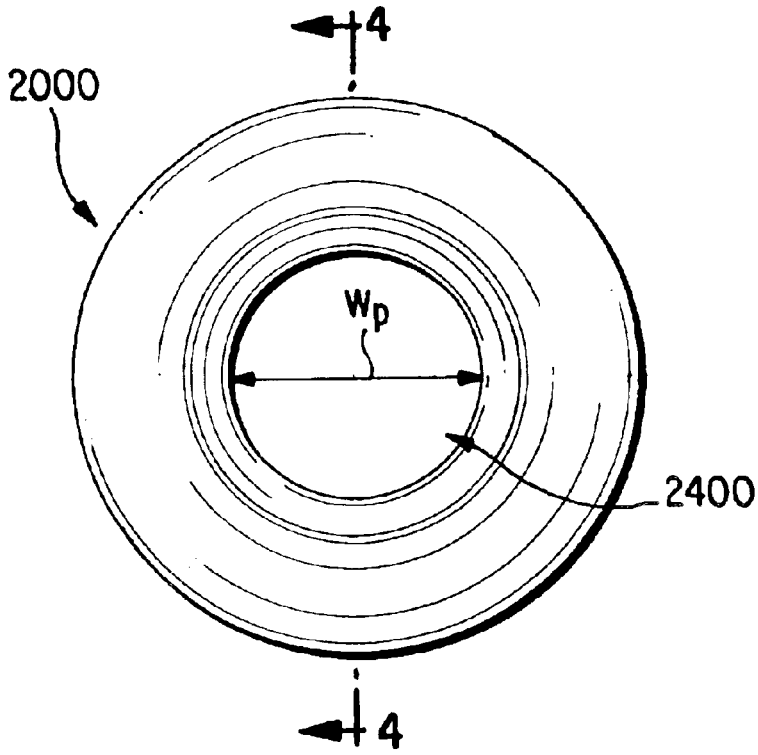
FIG. 3 is an end view of the exemplary hose retractor 2000 of FIG. 2.

FIG. 3. is an end view of the exemplary hose retractor 2000 of FIG. 2. Hose retractor 2000 can be a unitary toroidal shape, which can define a passage 2040 there-through having a minimum passage width $W_p$ that is greater than an outer width $W_h$ of hose 3000 (shown in FIG. 5). Retractor 3000 can have any weight, including a weight of about 0.25 pounds to about 3 pounds, including every value therebetween, including about 0.33, 0.50, 0.66, 0.75, 1.00, 1.20, 1.40, 1.50, 1.60, 1.80, 2.0, 2.25, 2.5, 2.75 pounds, etc., and/or every range therebetween. Much smaller and/or much larger weights are possible for certain hose and/or faucet configurations.

Figure 4:
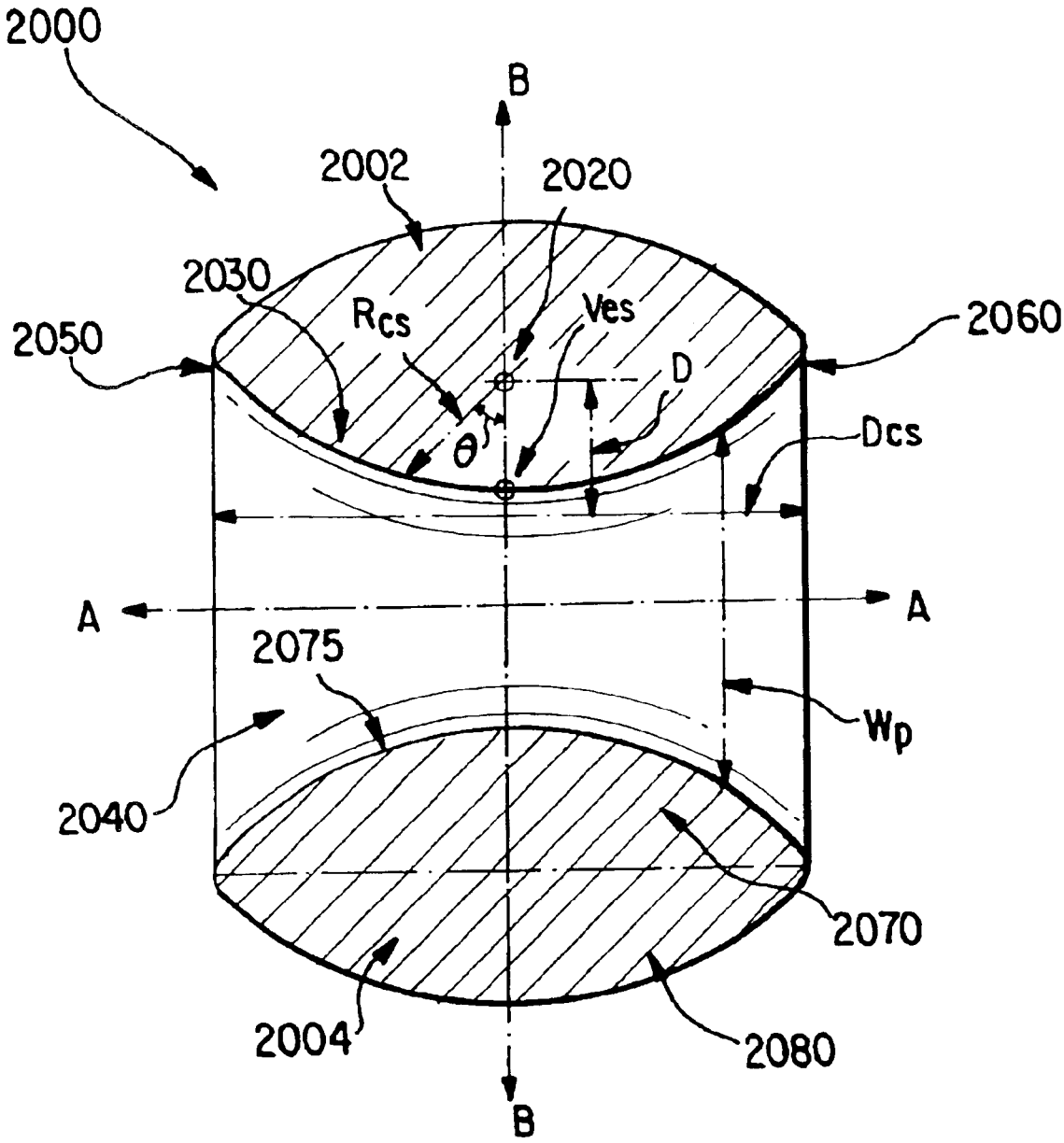
FIG. 4 is a cross-sectional view of the exemplary hose retractor 2000, taken along lines 4—4 of FIG. 3.

FIG. 4 is a longitudinal cross-sectional view of the exemplary hose retractor 2000 taken along lines 4—4 of FIG. 3. Hose retractor 2000 can define a longitudinal axis A—A and a passage 2040 having a passage width $W_p$ having a minimum value that is greater than a maximum value of the outer width $W_h$ of hose 3000 (shown in FIG. 5). In this longitudinal cross-sectional view of hose retractor 2000, two radially cut sections of retractor 2000 are shown, an upper section 2002 and a lower section 2004, which are separated in this view by passage 2040. Each of sections 2002 and 2004 can comprise an inner portion 2070, which is adjacent to passage 2040 and defines an inner surface 2075, and an outer portion 2080, which defines an outer surface 2090. Inner portion 2070 can have any closed shape, such as a regular polygon, an irregular polygon, and/or a conic segment of any curvature. Outer portion 2080 can have any closed shape, such as a regular polygon, an irregular polygon, and/or a conic segment of any curvature. Thus, inner portion 2070 can have a shape that is symmetrical, partially symmetrical, or non-symmetrical to outer portion 2080. Moreover, the shape of inner portion 2070 and/or outer portion 2080 can differ between section 2002 and section 2004.

In certain embodiments, inner portion 2070 and/or inner surface 2075 can define a conic segment 2030 with segment ends at 2050 and 2060 (which can be located at longitudinal ends of retractor 2000, or spaced inward therefrom), and having a width $W_{cs}$, a vertex $V_{cs}$, a directrix $D_{cs}$, a focal point 2020, and a conic segment radius of curvature $R_{cs}$ measured from focal point 2020 to inner surface 2075.

At any point along the conic segment 2030, the radius of curvature $R_{CS}$ can be defined generally as: $R_{CS}=(e*D)/(1-(e*\cos(\square)))$, where e is an eccentricity constant for the shape of the particular conic segment, D is the dimension from the focus to the directrix of the conic segment, and □ (shown in FIG. 4) is the angle to the radius from the line of symmetry B—B.

In certain embodiments, the minimum length of conic segment radius of curvature $R_{CS}$ can be greater than a minimum bending radius of hose 3000, yet small enough to prevent ends of retractor 2000, such as segment ends 2050 and 2060, from catching on the hose, including in the grooves of a spirally-wrapped hose, and/or to prevent the hose from wedging inside retractor 2000. Such a configuration for the conic segment can be helpful when the hose is relatively easily dysfunctionally deformable when subjected to the weight of retractor 2000, such as when the hose wall is constructed only of a polymer, or when any covering around the hose is itself relatively easily deformable.

In alternative embodiments, the minimum length of conic segment radius of curvature $R_{CS}$ can be equal to or less than a minimum bending radius of hose 3000. Such a configuration for the conic segment can be helpful when the hose is not relatively easily dysfunctionally deformable when subjected to the weight of retractor 2000, such as when the hose wall is constructed of a polymer surrounded by a helically-wrapped stainless steel covering. With this construction and/or geometry, the contact between retractor 2000 and hose 3000 can tend to form a point and/or line contact, or at least a substantially reduced contact area between retractor 2000 and hose 3000. In the case of certain hose coverings, such as helically-wrapped and/or braided coverings, the configuration of the covering can form a sort of mechanical limit (absent the application of substantially larger forces) on the bending radius easily formable with the hose, even if an underlying inner liner can bend in a tighter radius without adverse impact.

In certain embodiments, such as shown in FIG. 4, the conic segment can be a parabola, having e=1, a radius of curvature $R_{CS}=(2*a)/(1-\cos(\theta))$, where a is the distance from the vertex to the focal point.

In certain alternative embodiments (not shown), the conic segment can be an ellipse, in which e<1 and e=c/a, where c=distance from center to a focal point=(a^2−(b^2)^0.5, where a is half the length of the major axis, b is half the length of the minor axis, and $R_{CS}=a(1-e^2)/(1-e*\cos(\theta))$. In those cases where e=0, the ellipse is actually a circle with $R_{CS}$=constant.

In certain alternative embodiments (not shown), the conic segment can be one half of a hyperbola, in which e>1, and $R_{CS}=a*(e^2-1)/(1-(e*\cos(\theta)))$, where a, b, and e are defined the same as for an ellipse, but c=(a^2+(b^2)^0.5.

Hose 3000 can be inserted through passage 2040 of hose retractor 2000 so that hose retractor 2000 surrounds at least a portion of hose 3000. The interaction of the inner surface 2075 of hose retractor 2000 with an outer surface of hose 3000 can be sufficiently "slippery" or low in friction that hose retractor 2000 can freely slide along hose 3000 when hand-held spray faucet 5000 (shown in FIG. 1) is repositioned to a desired position of use 5100 away from its home position 5075. That is, a static coefficient of friction between retractor 2000 and hose 3000 can be less than about 0.04, 0.059, 0.075, 0.0833, 0.01, 0.119, 0.125, 0.142, 0.15, 0.160, 0.1798, 0.20, 0.221, 0.2395, 0.25, 0.26, 0.28, and/or 0.30, including every value therebetween and/or every range therebetween.

The static coefficient of friction between the inner surface of retractor 2000 and hose 3000 (or some other flexible member inserted through the passage of retractor 2000, and for which retractor 2000 can assist in retracting, such as any sort of hose, tube, communication cable, wire, electrical cord, flexible conduit, optical fiber, cable, rope, twine, yarn, string, cord, etc.) can be measured using a force gage, such as the Chatillon lines of mechanical or digital force gages by Ametek of Largo, Fla., or can be determined by the angle technique.

To perform the angle technique, hose 3000 can be extended horizontally along a flat horizontal surface, retractor 2000 can be placed adjacent a movable end of hose 3000 and a known distance from a fixed end of hose 3000, and the movable end of hose 3000 can be raised vertically until retractor 2000 starts to slide along hose 3000. The height at which retractor 2000 started to slide can be divided by the known length between the fixed end and the initial position of the retractor on the hose to arrive at the static coefficient of friction.

For example, using the angle technique, the following static coefficients of friction between an inner surface of the retractor and the following flexible members were found:

polypropylene rope: about 0.05 to about 0.15;

plastic-coated laptop computer security cable: about 0.10 to about 0.20;

coaxial communications cable: about 0.20 to about 0.30.

To achieve a desired value and/or range of the static coefficient of friction, the inner surface 2075 of hose retractor 2000 can be constructed of a material, such as a plastic (e.g., high-density polyethylene, nylon, ABS, etc.) and/or can have a relatively smooth surface finish, having an average surface roughness less than about 250, 125, 64, 32, 16, and/or 8 microinches (as measured by according to ASME B46.1), including every value therebetween and/or every range therebetween. In certain embodiments (not shown), hose retractor 2000 can have a relatively dense core, such as lead, substantially encased by a coating, covering, and/or cladding, such as a plastic. The coefficient of friction, surface finish, dimensions, materials, geometry, weight, and/or other properties of retractor 2000 can be selected to correspond with the particular hose 3000 that will be utilized with a particular faucet, and/or can be selected to work with a wide and/or narrow range of hoses, including various hose types, materials, diameters, wall thicknesses, lengths, etc.

Figure 5:
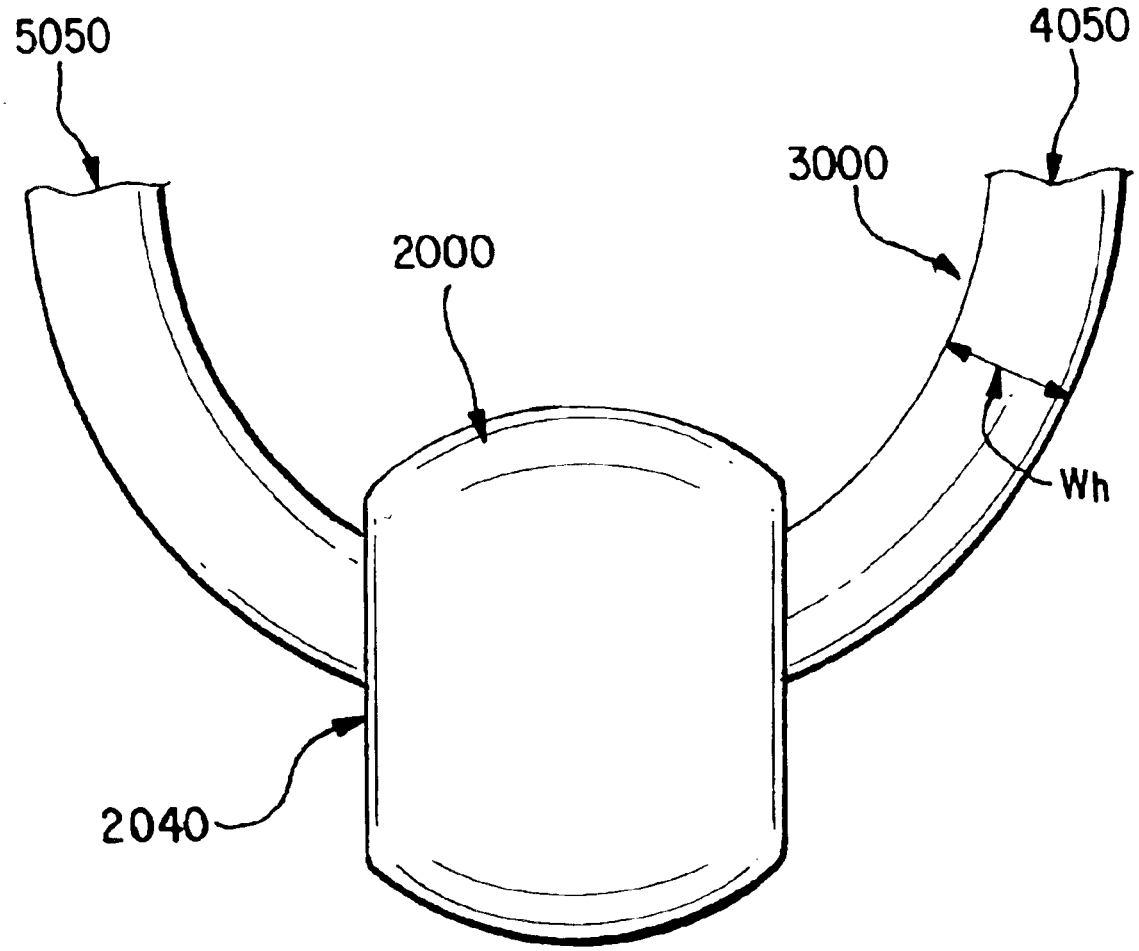
FIG. 5 is a side view of the exemplary hose retractor 2000 and hose 3000 of FIG. 1.

FIG. 5 is a side view of the exemplary hose retractor 2000 and hose 3000 of FIG. 1. When positioned correctly, hose retractor 2000 surrounds hose 3000, which is inserted through passage 2040 and comes to rest between terminal end 4050 of hose 3000 and terminal end 5050 of hose 3000. A radius of curvature $R_H$ of hose 3000 can be minimally constrained by a minimum radius of curvature $R_{CS}$ of an inner portion 2070 and/or inner surface 2075 of retractor 2000 (shown in FIG. 4). In certain embodiments, the hose radius of curvature $R_H$ can be minimally constrained by a projected radius of curvature $R_{cs}$ of inner portion 2070 and/or inner surface 2075 (shown in FIG. 4). That is, although when viewed very closely, inner portion 2070 and/or inner surface 2075 can comprise a micro-surface that is rapidly undulating and/or varying in curvature, a projection of that micro-surface (e.g., a macro-surface) can define a larger radius of curvature $R_{CS}$ that minimally constrains $R_H$. Thus, regardless of the curvature of its micro-surface, inner portion 2070 and/or inner surface 2075 can define a radius of curvature $R_{CS}$ that minimally constrains $R_H$, i.e., that resists a bending of hose 3000 into a radius that is less than the minimum bending radius of hose 3000.

Figure 6:
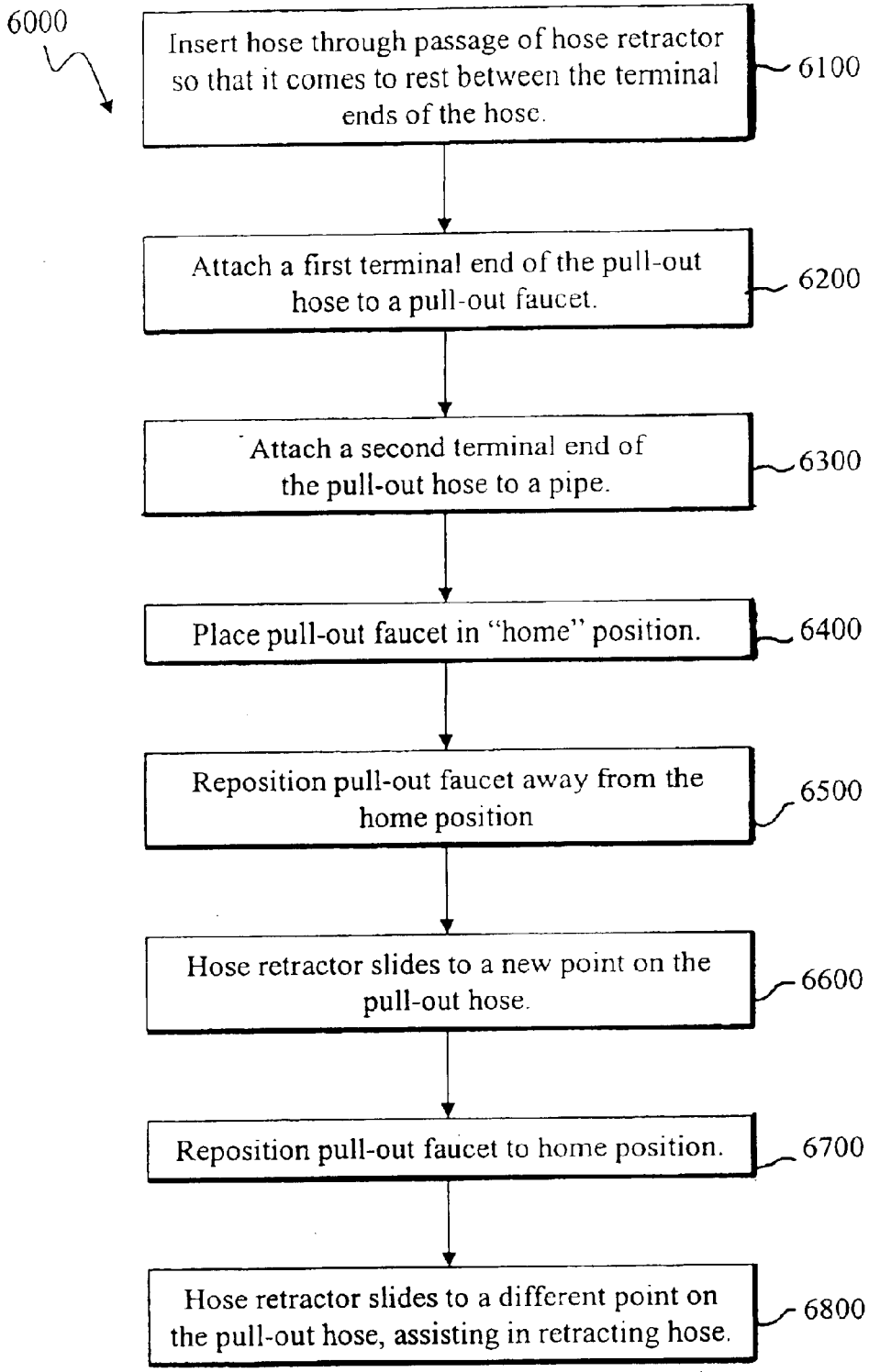
FIG. 6 is a flow chart of an exemplary method 6000 of the present invention.

FIG. 6 is a flow-chart an exemplary embodiment of a method 6000 of retracting a hose, such as a hose for a pull-out faucet. At activity 6100, hose 3000 is inserted through passage 2040 of hose retractor 2000 so that hose retractor 2000 comes to rest between the terminal ends 4050 and 5050 of hose 3000. At activity 6200, a fluid flow regulation device, such as a hand-held spray faucet 5000, is attached at a terminal end 5050 of hose 3000. At activity 6300, a fixed fluid dispensing device, such as a water pipe 4000, is attached to a terminal end 4050 hose 3000. At activity 6400, the fluid flow regulation device, such as hand-held spray faucet 5000, is positioned in a "home" position 5075. At activity 6500, the fluid flow regulation device, such as hand-held spray faucet 5000, is repositioned to a desired position of use 5100 away from its home position 5075. At activity 6600, hose retractor 2000 travels along hose 3000 to a new point on hose 3000. At activity 6700, hand-held spray faucet 5000 is repositioned to "home" position 5075. At activity 6800, while faucet 5000 is being repositioned, hose retractor 2000 slides freely along hose 3000, assisting in retracting hose 3000 and hand-held spray faucet 5000.

Figure 7:
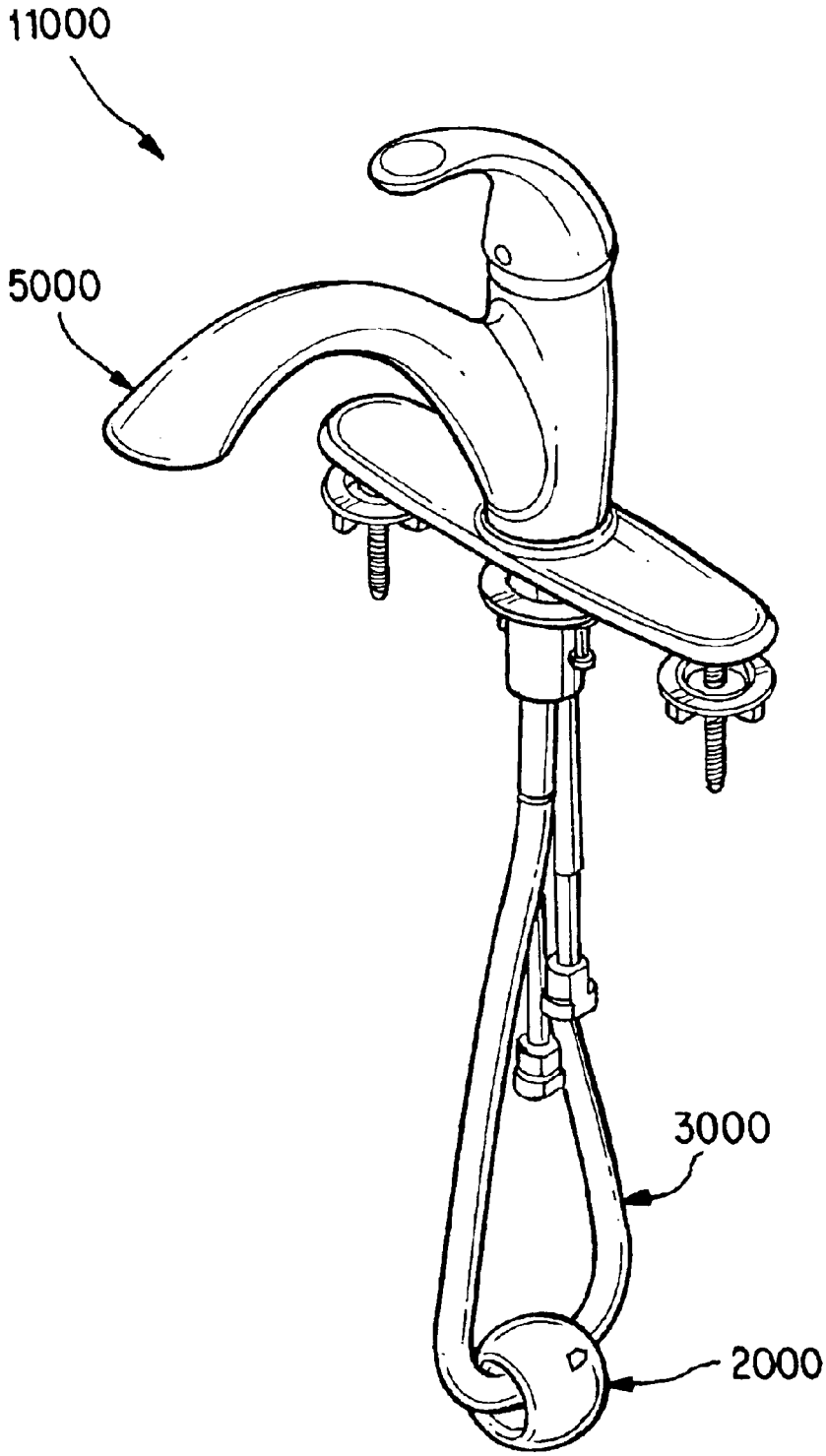
FIG. 7 is a perspective view of an embodiment of an alternative system 11000 of the present invention.

FIG. 7 is a perspective view of an exemplary embodiment of an alternative embodiment 11000 of system of the present invention showing an exemplary hose retractor 2000 slideably mounted on a hose 3000 for a pull-out hand held spray faucet 5000.

Certain embodiments of the present invention can utilized with hoses that do not have pull-out faucets attached. For example, an embodiment of a retractor of the present invention can be used with nearly any type of hose or tube, such as a garden hose, industrial dishwashing hose, lab hose, pneumatic hose, vacuum hose, welding hose, intravenous tube, etc. Certain embodiments of the present invention can be used with nearly any type of elongated flexible member, such as a rope, twine, string, yarn, wire, cable, electrical cord, communications cable, telephone wire, flexible conduit, optical fiber, etc.

For instance, an exemplary embodiment of retractor according to the present invention can be used to help keep moderate tension on an electrical cord for a soldering iron, to help keep the cord out of the way of one using the soldering iron, and to retract the cord when the soldering iron is returned to a "home" position. Likewise, an exemplary embodiment of retractor according to the present invention can be used with a pull-out vacuum hose to help retract the hose into a storage cavity when not in use and/or when that portion of the hose does not need to be extended from the cavity.

Although the invention has been described with reference to certain specific exemplary embodiments thereof, it will be understood that numerous variations, modifications and additional embodiments are possible, and accordingly, all such variations, modifications, and embodiments are to be regarded as being within the spirit and scope of the invention. Accordingly, the drawings and descriptions are to be regarded as illustrative in nature, and not as restrictive.

What is claimed is:

1. A device comprising: a unitary toroidal hose retractor for use with a pull-out hose, said hose retractor defining a passage there-through having a passage width greater than an outer width of the pull-out hose, an inner portion of a radial cross-section of said hose retractor defining a conic segment having a focal point and a conic segment radius measured from said focal point, wherein a static coefficient of friction between a surface of said inner portion of the radial cross-section of said hose retractor and a surface of the pull-out hose is less than about 0.20.

2. The device of claim 1, wherein said static coefficient of friction is less than about 0.15.

3. The device of claim 1, wherein said static coefficient of friction is less than about 0.10.

4. The device of claim 1, wherein said static coefficient of friction is less than about 0.075.

5. The device of claim 1, wherein said hose retractor is slideably coupleable to the pull-out hose.

6. The device of claim 1, wherein said hose retractor is adapted to slideably surround a portion of the pull-out hose.

7. The device of claim 1, wherein said hose retractor comprises a polymer-encased metallic core.

8. The device of claim 1, wherein said conic segment radius is greater than a minimum bending radius of the pull-out hose.

9. The device of claim 1, wherein said conic segment radius is less than a minimum bending radius of the pull-out hose.

10. The device of claim 1, wherein said conic segment radius is approximately equal to a minimum bending radius of the pull-out hose.

11. The device of claim 1, wherein said hose retractor has a hose retractor mass greater than a combined mass of a fluid dispensing device, a first portion of the pull-out hose located between said hose retractor and the fluid dispensing device, and a fluid contained within the first portion, said hose retractor mass less than a deformation mass required to dysfunctionally deform the pull-out hose when said hose retractor mass is applied over an area defined by contact of said hose retractor mass with the pull-out hose.

12. A system comprising:

a pull-out hose; and a unitary toroidal hose retractor for use with said pull-out hose, said hose retractor defining a passage there-through having a passage width greater than an outer width of said pull-out hose, an inner portion of a radial cross-section of said hose retractor defining a conic segment.

13. The system of claim 12, wherein said pull-out hose is connectable to a moveable fluid flow regulation device at a first terminal end of said pull-out hose.

14. The system of claim 12, wherein said pull-out hose is connectable to a fluid dispensing device at a second terminal end of said hose.

15. The system of claim 12, wherein the pull-out hose is connectable to a moveable faucet at a first terminal end of said pull-out hose.

16. The system of claim 12, wherein the pull-out hose is connectable to a moveable spray nozzle at a first terminal end of said pull-out hose.

17. The system of claim 12, wherein said pull-out hose is connectable to a pipe at a second terminal end of said hose.

18. The system of claim 12, wherein said hose retractor has a hose retractor mass greater than a combined mass of a fluid dispensing device, a first portion of said pull-out hose located between said hose retractor and the fluid dispensing device, a fluid contained within said first portion, said hose retractor mass less than a mass required to dysfunctionally deform said pull-out hose when said hose retractor mass is applied over an area defined by contact of said hose retractor mass with said pull-out hose.

19. The system of claim 12, wherein a static coefficient of friction between a surface of said inner portion of the radial cross-section of said hose retractor and a surface of the pull-out hose is less than about 0.18.

20. The system of claim 12, wherein a static coefficient of friction between a surface of said inner portion of the radial cross-section of said hose retractor and a surface of the pull-out hose is less than about 0.12.

21. The system of claim 12, wherein a static coefficient of friction between a surface of said inner portion of the radial cross-section of said hose retractor end a surface of the pull-out hose is less than about 0.09.

22. The system of claim 12, wherein a static coefficient of friction between a surface of said inner portion of the radial cross-section of said hose retractor and a surface of the pull-out hose is less than about 0.06.

23. A method of providing a pull-out hose and a hose retraction device comprising the activities of:

providing a pull-out hose; and providing a unitary toroidal hose retractor for use with the pull-out hose, the hose retractor defining a passage there-through having a passage width greater than an outer width of the pull-out hose, an inner portion of a radial cross-section of the hose retractor defining a conic segment.

24. The method of claim 23, further comprising inserting the pull-out hose through the passage of the hose retractor.

25. The method of claim 23, further comprising attaching a first terminal end of the hose to a fluid flow regulation device.

26. The method of claim 25, further comprising attaching a second terminal end of the hose to a fixed fluid dispensing device.

27. The method of claim 25, further comprising placing the fluid flow regulation device in an initial position of rest.

28. The method of claim 27, further comprising repositioning the fluid flow regulation device in a desired position away from an initial position.

29. The method of claim 25, further comprising allowing the hose retractor to assist with returning the fluid flow regulation device from a desired position to an initial position.

30. The method of claim 23, further comprising allowing the hose retractor to slide along the pull-out hose.

31. The method of claim 23, wherein the contact coefficient of friction between a surface of said inner portion of the radial cross-section of said hose refractor and a surface of the pull-out hose is sufficiently low in friction to allow said hose retractor to freely slide along the pull-out hose.

32. The method of claim 23, wherein said hose retractor has a hose retractor mass greater than a combined mass of a first portion of the pull-out hose located between the hose retractor and a fluid dispensing device, a fluid contained within the first portion, and the fluid dispensing device, said hose retractor mass less than a mass required to dysfunctlonally deform the pull-out hose when said hose retractor mass is applied over an area defined by contact of said hose retractor mass with the pull-out hose.

33. A method of retracting a pull-out hose comprising the activities of:

inserting a pull-out hose through a passage defined by a unitary toroidal hose retractor for use with the pull-out hose, defining a passage there-through having a passage width greater than an outer width of the pull-out hose, an inner portion of a radial cross-section of the hose retractor defining a conic segment;

attaching a first terminal end of the pull-out hose to a fluid flow regulation device;

attaching a second terminal end of the pull-out hose to a fixed fluid dispensing device;

positioning the pull-out hose in a manner that allows the hose retractor to freely slide to a position between the first terminal end of the pull-out hose and the second fixed terminal end of the pull-out hose.

34. The method of claim 33, further comprising slideably coupling the hose retractor to the pull out hose.

35. The method of claim 33, wherein the contact coefficient of friction between a surface of said inner portion of the radial cross-section of said hose retractor and a surface of the pull-out hose is sufficiently low in friction to allow said hose retractor to freely slide along the pull-out hose.

36. The method of claim 33, wherein said hose retractor has a hose retractor mass greater than a combined mass of a first portion of the pull-out hose located between the hose retractor and a fluid dispensing device, a fluid contained within the first portion, and the fluid dispensing device, said hose retractor mass less than a mass required to dysfunctionally deform the pull-out hose when said hose retractor mass is applied over an area defined by contact of said hose retractor mass with the pull-out hose.

37. A device comprising: a unitary toroidal hose retractor for use with a pull-out hose, said hose retractor defining a passage there-through having a passage width greater than an outer width of the pull-out hose, an inner portion of a radial cross-section of said hose retractor defining a retractor inner radius of curvature greater than a minimum bending radius of the pull-out hose.

38. A device comprising: a unitary toroidal hose retractor for use with a pull-out hose, said hose retractor defining a passage there-through having a passage width greater than an outer width of the pull-out hose, an inner portion of a radial cross-section of said hose retractor defining a conic segment having a focal point and a conic segment radius measured from said focal point, said conic segment radius equal to or less than a minimum bending radius of the pull-out hose.

39. A device comprising: a unitary toroidal retractor for use with a elongate flexible member, said retractor defining a passage there-through having a passage width greater than an outer width of the elongated flexible member, an inner portion of a radial cross-section of said retractor defining a conic segment having a focal point and a conic segment radius measured from said focal point wherein a static coefficient of friction between a surface of said inner portion of the radial cross-section of said retrector and a surface of the elongated flexible member is less than about 0.30.

* * * * *